United States Patent [19]

Svoboda et al.

[11] Patent Number: 4,508,361

[45] Date of Patent: Apr. 2, 1985

[54] SAFETY SKI BINDING

[75] Inventors: Josef Svoboda, Schwechat; Theodor Nitschko; Heinz Wittmann, both of Vienna, all of Austria

[73] Assignee: TMC Corporation, Baar, Switzerland

[21] Appl. No.: 441,148

[22] Filed: Nov. 12, 1982

[30] Foreign Application Priority Data

Nov. 12, 1981 [AT] Austria ..... 4854/81

[51] Int. Cl.[3] ..... A63C 9/08

[52] U.S. Cl. ..... 280/628; 280/634

[58] Field of Search ..... 280/628, 629, 630, 631, 280/632, 633, 634

[56] References Cited

U.S. PATENT DOCUMENTS 4,421,341 12/1983 Krob ..... 280/628

FOREIGN PATENT DOCUMENTS 671328 10/1963 Canada ..... 280/629

2163022 6/1973 Fed. Rep. of Germany ..... 280/632

2838904 3/1980 Fed. Rep. of Germany ..... 280/632

*Primary Examiner*—Joseph F. Peters, Jr.

*Assistant Examiner*—Joseph G. McCarthy

*Attorney, Agent, or Firm*—Flynn, Thiel, Boutell & Tanis

[57] ABSTRACT

A heel holder includes a sole holder which is supported for pivotal movement about a horizontal axis on a support member and has a control surface. A locking lever pivotally supported on the support member has a nose engageable with the sole holder control surface. A spring housing having a release spring therein is pivotal about the sole holder pivot axis, and a slide member movably supported in the spring housing is biased by the release spring against a side of the lever opposite the nose thereof when the spring housing is in an initial position. A centering spring is cooperable with the spring housing and with the sole holder or the support member and, after pivotal movement of the spring housing away from its initial position, urges the spring housing back toward such position.

11 Claims, 15 Drawing Figures

SAFETY SKI BINDING

FIELD OF THE INVENTION

This invention relates to a safety ski binding and, more particularly, to a heel holder having a sole holder supported for pivotal movement around a swivel axis on a support member which, if desired, is itself pivotal about a vertical axis, the sole holder and the support member being held in a downhill skiing position holding the ski shoe by at least one locking mechanism which yields only when certain elevational and, if desired, lateral release forces are overcome, the effective release force being reduced with a progressive change in the direction of the force away from the vertical, preferably to a predetermined limit, wherein the locking mechanism includes a locking element provided on a swingable lever which has on a side which does not face the locking element a control surface on which is supported a slide member which is biased by a release spring supported by a spring housing in a pivotally supported release lever which controls voluntary releases.

BACKGROUND OF THE INVENTION

A safety ski binding of the above-mentioned type is disclosed for example in German OS No. 28 38 904. In this conventional design, particularly FIG. 6, the control surface which is constructed on the lever includes a locking trough which the slide member biased by the release spring engages. A voluntary opening of the sole holder is possible only by pressing down on the release lever, and this occurs against the force of the release spring. Closing the sole holder requires either a pivoting of the release lever with a subsequent pressing down of the sole holder, or a pressing down of the sole holder with a subsequent swivelling of the release lever to its initial position Therefore, the release lever must be operated during closing or during stepping into the binding with a ski shoe.

A purpose of the invention is therefore to bring help here and provide a safety ski binding of the above-mentioned type in which the locking element carrier, after a release operation or after a voluntary stepping out of the binding, is returned automatically to its initial position and is held in this position during a stepping in. This is to be so even if the direction of the stepping in should differ somewhat from the vertical.

SUMMARY OF THE INVENTION

The set goal is achieved inventively by the slide member lying, in every position of the lever for downhill skiing, substantially normal to its control surface, and by the release lever and the spring housing for the release spring being swingable against the force of at least one centering spring. The centering spring can be constructed as a leaf spring having one end supported on the spring housing and a section adjacent such end supported, at least in the downhill skiing position, on the sole holder, preferably on a surface thereof which does not face the down-holding means, or can be constructed as a helical spring having one end supported on the spring housing and the other end supported on the sole holder or on the support member. The centering spring can also be the release spring of the binding, the swivel axis of the spring housing being formed by a centering bolt which extends through the slide member, is secured nonrotatably on the support member, and is provided on its side which faces the release spring with a preferably flat control surface which, at least in the downhill skiing position of the binding, engages a surface of the slide member which is preferably flat and is urged by the release spring against the bolt control surface.

The inventively designed ski binding can be manually released to facilitate an arbitrary stepping out of the binding by overcoming only the force of a spring which has a substantially smaller force than the release spring, so that a skier, after a fall and even in an unfavorable position, can get out of the unopened binding without anyone's help. Further, for opening the binding in a standing position for a voluntary stepping out, it is favorable if, instead of the high resistance of the release spring, only the smaller resistance of the centering spring must be overcome. Also, to close the ski binding after an arbitrary opening, only a swinging down of the sole holder is needed.

An advantageous embodiment of the invention includes the leaf spring being secured on a part of the spring housing which covers the release spring from above, being supported, preferably with a small initial tension, on an inner surface of the sole holder which faces the lever, and then extending between two support pins which are secured on the support member parallel to the swivel axis of the spring housing and are offset relative to one another longitudinally of the ski and preferably also in a direction normal to the upper side of the ski. In this manner, a return or centering of the spring housing after an opening of the ski binding by pressing or by pulling on the release lever is assured. The leaf spring is given, by each of the support pins, a tension which effects the centering.

A further development of this thought of the invention includes the section of the leaf spring which is adjacent the end which is secured on the spring housing being provided, in the region between the two support pins, with two support indentations which are each associated with a respective one of the support pins. By supporting each support pin in an indentation in the leaf spring, deformation of the leaf spring in this region is avoided and a secure centering of the release lever and the spring housing is assured.

A further inventive embodiment provides that the section of the leaf spring adjacent the end which is secured on the spring housing is, in the relaxed position of the leaf spring, approximately V-shaped and, in the downhill skiing position of the safety ski binding, is supported to extend in approximately the same longitudinal direction as the spring housing and thus applies a strong initial tension to the sole holder, preferably on an inner surface of the same which faces the lever. The leaf spring, in the open position of the safety ski binding in which it is ready for a stepping in, is relaxed, or if desired has a slight initial tension. Through this arrangement of the leaf spring, a centering of the spring housing is assured after opening the sole holder by swivelling the release lever either by pulling on or pressing on such lever, since the leaf spring assumes its fully relaxed or substantially relaxed condition only in the position of the ski binding which is ready for stepping in and after the centering or return of the spring housing to its initial position.

A further feature of the invention involves movement of the spring housing, together with the release lever, being limited by at least one and preferably two stops which are fastened on the support member and project under the two side walls of the spring housing, thereby preventing swivelling due to pulling on the release lever. In this manner, an arrangement of the centering spring on a ski binding which, with respect to its function, is supposed to be simple and uncomplicated is possible.

It is furthermore advantageous if the leaf spring, in the region of the tip of its V-shaped portion, can, during a swinging up of the release lever and spring housing, engage and be tensioned by support rams secured on the support member on both sides in an upper region thereof. In this manner, the leaf spring receives, in the region of the tip of its "V" and during an opening of the sole holder through a swivelling of the release lever caused by pulling on it, an additional tension which assists the return or centering of the spring housing and the release lever.

An important advantage exists when the leaf spring is arranged to simultaneously function as a spring which biases the sole holder in the direction of its open position. Thus, the arrangement of a separate opening spring is not needed.

A further inventive development involves the provision of a helical compression spring as the centering spring, which spring is arranged in a preferably cylindrical spring housing which is secured on the underside of the spring housing for the release spring. One end of the pressure spring is supported on an abutment which is fixedly connected to the spring housing and the other end, if desired with the interpositioning of an abutment which is movable within the centering spring housing, is supported on a support bolt which extends parallel with respect to the swivel axis in the region below the swivel axis and is secured to the sole holder. In this manner, a return or centering of the release spring housing and release lever after opening the sole holder by pressing on the release lever is assured. The arrangement of the helical centering spring in a spring housing which is fixedly connected to the release spring housing is simple and space-saving.

In order to permit the support bolt which is secured on the sole holder to carry out relative movement with respect to the support member during swivelling of the sole holder, it is provided inventively that the support bolt extends through arcuate slots provided in each of the two side walls of the support member, which slots are concentric with respect to the swivel axis.

The helical spring can also be an expansion spring which is arranged in a preferably cylindrical spring housing secured on the upper side of the spring housing for the release spring, one end of the spring being supported on an abutment part which is fixedly connected to the spring housing and the other end being supported on a support bolt which extends parallel with respect to and in the region above the swivel axis and is secured to the sole holder. The expansion spring functions in a manner similar to the just-described compression spring and also has the advantages thereof, for example the simple housing which requires few structural changes. Moreover, the provision of slots in the support member is not necessary in this case.

A further embodiment of the invention includes two helical compression springs which are each arranged in a respective and preferably cylindrical spring housing, one such housing being provided on and above and the other on and below the spring housing for the release spring. One end of each spring is supported on a respective abutment which is fixedly connected to the spring housing, and the other end, if desired with the interpositioning of an abutment which is movable in the centering spring housing, is supported on a respective support bolt which is secured to the support member and extends parallel to the swivel axis of the release spring housing. Through this arrangement of two helical compression springs, a return of the spring housing and the release lever after an opening of the sole holder by pressing on or by pulling on the release lever is assured.

A further thought of the invention consists in the diameter of each support bolt being less than the diameter of the associated centering spring housing, and each spring housing being provided at its end which faces the support bolt with recesses for receiving the support bolt. In this manner, the support bolt which compresses the spring during swivelling of the release lever can be received by the spring housing, wherein in the relaxed position of the spring its guiding in the spring housing is fully maintained.

If the release spring itself is to serve as the centering spring, then it is advantageous if inventively the slide member, through which the centering bolt extends, includes two slide-member parts, one slide-member part being supported on the lever, being guided in a conventional manner in slots of the spring housing, and being engaged by the second slide-member part, which is under the action of the release spring and is designed as an approximately U-shaped structural part, between the legs of which the centering bolt extends. Through this measure, a satisfactory functioning of the binding during a safety release and a centering of the spring housing after a voluntary opening by pulling on or by pressing on the release lever is assured.

BRIEF DESCRIPTION OF THE DRAWINGS

Further characteristics, advantages and details of the invention will now be described in greater detail in connection with the drawings, which illustrate several exemplary embodiments of an inventive safety ski binding.

In the drawings.

DETAILED DESCRIPTION

Figure 1:
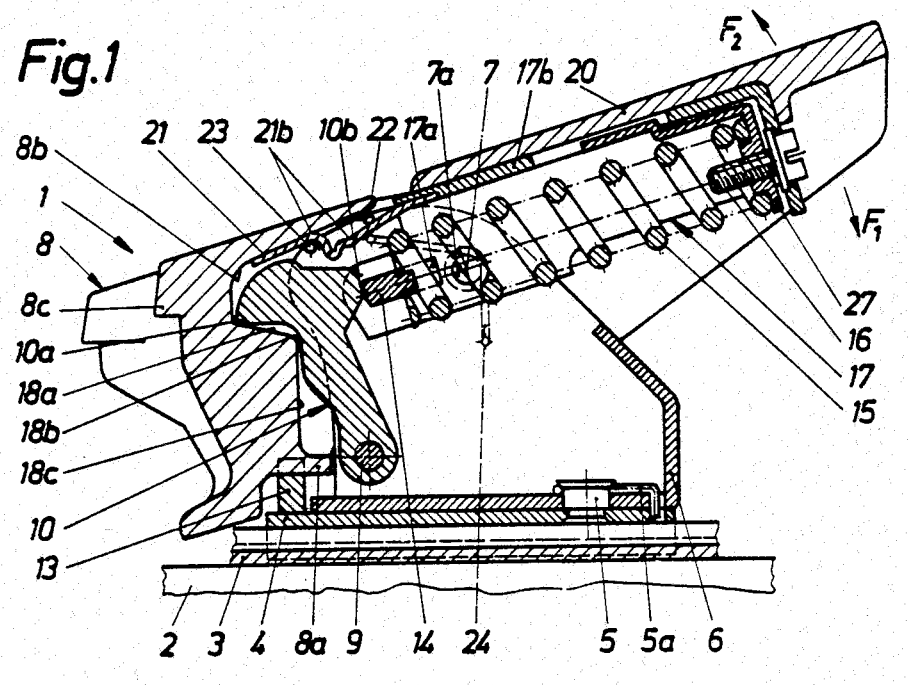
FIGS. 1 to 3 are sectional side views of a first exemplary embodiment of an inventive safety ski binding, FIG. 1 showing the binding in a downhill skiing position, FIG. 2 showing the binding in a position during a voluntary release by pressing on a release lever, and FIG. 3 showing the binding in a position during a voluntary release by pulling on the release lever, the release lever itself being omitted in FIGS. 2 and 3.

In the individual exemplary embodiments, identical structural parts have been identified throughout with the same reference numerals, and parts which fulfill the same function but differ structurally are identified by similar reference numerals.

Figure 2:
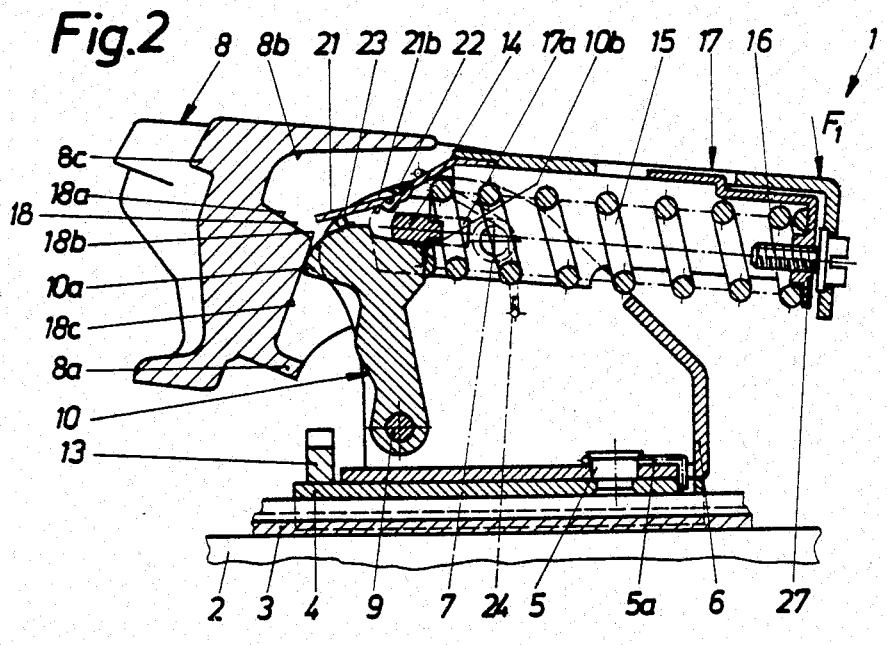
Figure 3:
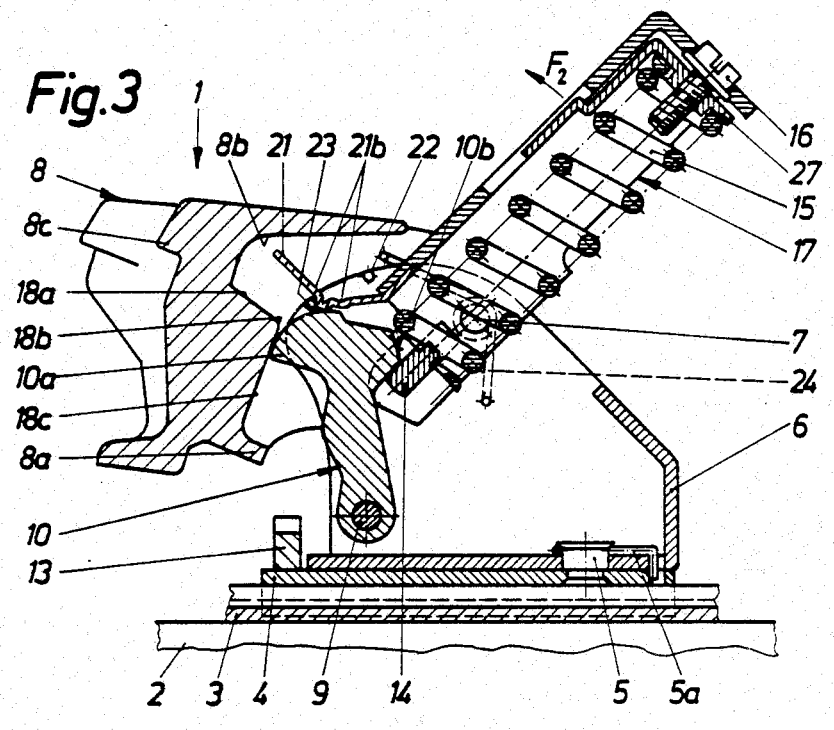

In the first exemplary embodiment according to FIGS. 1 to 3, a safety ski binding which as a whole is identified as a heel holder 1 can be recognized. The heel holder 1 is held in a conventional manner against a lifting off from the upper side of the ski 2 by means of a base plate 4 supported for sliding movement along a guide rail 3 which in turn is secured on the upper side of the ski 2 in a conventional manner by screws which are not illustrated. To adjust the binding to different length ski shoes, the heel holder 1 can be moved by means of the base plate 4 relative to the guide rail 3 in a direction longitudinally of the ski 2 and can be secured in a conventional manner in any desired position. The structure and operation of the longitudinal adjustment mechanism is not a part of the subject matter of the present invention, and is therefore not illustrated and described in detail.

Figure 1A:
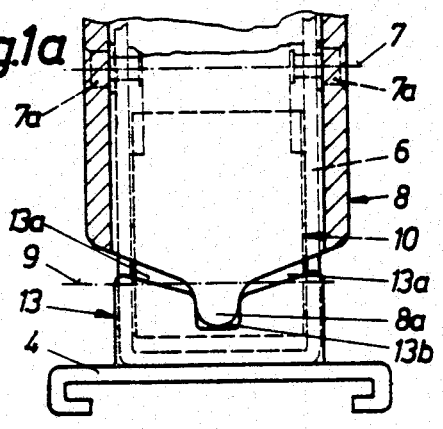
FIG. 1*a* is a sectional front view of the binding of FIG. 1.

A vertical axis is constructed as a pivot pin 5 which is riveted in the base plate 4, about which vertical axis a support member 6 of the heel holder 1 is supported for pivotal movement in horizontal directions, preferably and in a conventional manner against the force of a conventional return spring 5*a*. The support member 6 has in its upper region a swivel axle 7 which extends transversely to the longitudinal axis of the ski and parallel to the upper side of the ski 2. The swivel axle 7 is formed by two swivel pins 7a (see FIG. 1*a*), which pins 7*a* pivotally support a sole holder 8 which has a downholding portion 8*c*. A further holding axle 9 which extends parallel to the swivel axle 7 is arranged in the lower region of the support member 6, which holding axle 9 pivotally supports a locking lever 10. Furthermore, a spring housing which as a whole is identified with reference numeral 17 is pivotal about the swivel axle 7, the details of which spring housing will be discussed later on.

The lever 10 has a nose 10*a* which serves to lock the sole holder 8 against a swinging up, and in the downhill skiing position of the heel holder 1 is supported on a locking surface or shoulder 18*a* of a control surface 18 (FIG. 2) of the sole holder 8. The locking surface 18*a* of the control surface 18 extends, in the downhill skiing position of the heel holder 1, at an acute angle with respect to the upper side of the ski and transfers through an edge 18*b* into a section 18*c* which extends substantially vertically toward the upper side of the ski 2. The locking arrangement which resists a swinging in a horizontal direction includes, as can be seen from FIG. 1*a*, a nose 8*a* which is constructed on the sole holder 8 and, in the downhill skiing position of the heel holder, engages a notch or recess 13*b* of a cam surface 13*a* which is constructed on a part 13 which is fixedly connected to the base plate 4.

Figure 1B:
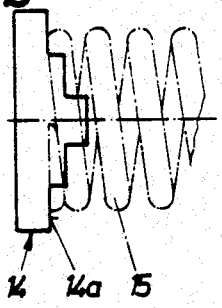
FIG 1*b* is a top view of a component of the binding of FIG. 1.

A control surface 10*b* is provided on the side of the lever 10 opposite the nose 10*a*, which control surface is engaged by a platelike slide member 14. The slide member 14 is arranged approximately normal to the control surface 10*b*. The slide member 14 is biased by one end of a release spring 15, the other end of which is supported on an abutment 27 which, in a conventional manner, is adjustable longitudinally of the spring housing 17 by means of an adjusting screw 16. The adjusting screw 16 is supported rotatably in the spring housing 17 which surrounds the spring 15, but is fixed against movement in the longitudinal direction of the spring housing 17. The entire spring housing 17 is pivotal about the swivel axle 7 in either the direction of the arrow $F_1$ or the direction of the arrow $F_2$ by means of a release lever 20 which is secured thereto and partially surrounds the support member 6. The spring housing 17 has side walls which are positioned normal to the upper side of the ski and which each have a longitudinal slot 17*a*, in which longitudinal slots 17*a* the slide member 14 is slidably supported and is biased by the force of the release spring 15. The end of the release spring 15 is supported on flanges or extensions 14*a* of the slide member 14, as can be seen in FIG. 1*b*, which illustrates the slide member 14 of FIG. 1 in a top view. In the downhill skiing position of the heel holder 1, the slide member 14 is adjacent the ends of the longitudinal slots 17*a* of the spring housing 17 which are nearest the lever 10. The spring housing 17 is held in an initial position in which the slide member 14 is positioned on the control surface 10*b* of the lever 10 only by the force of a relatively weak centering spring 21, the design of which will yet be discussed in detail, so that during a voluntary release by swinging the release lever 20 in the direction of either the arrow $F_1$ or the arrow $F_2$, only the force of the weak centering spring 21 must be overcome. The release spring 15, of course, resists an automatic release through its respectively adjusted force. The arrangement is such that the heel holder 1 is blocked against a purely lateral release by the engagement of sole holder nose 10*a* in recess 13*b* of the cam surface 13*a* of the part 13. Therefore, as is known, a not illustrated front jaw is responsible for a purely lateral release operation. In the case of combined, so-called diagonal forces which act on the ski shoe, the cam surface 13*a* of the locking part 13 comes into play.

The centering spring 21 is constructed as a leaf spring which, viewed from above, has an approximately rectangular shape. One end of the leaf spring 21 is secured in a conventional and not illustrated manner to a part 17*b* of the spring housing 17 which covers the release spring 15 from above. For example, the spring 21 can be riveted to the underside of the part 17*b*, which underside defines part of the inside of the spring housing 17. Starting out from this end, the leaf spring 21 extends between the spaced side walls of the support member 6 in a direction toward the sole holder 8 and into the region between the lever 10 and an inner surface 8*b* of the sole holder 8 provided above the lever 10. The leaf spring 21 is supported with a small initial tension in the downhill skiing position of the heel holder 1 on the inner surface 8b of the sole holder 8. In this manner, a bothersome rattling of the leaf spring 21 during skiing is avoided. In the downhill skiing position of the heel holder 1, the leaf spring 21 extends longitudinally in a direction approximately parallel to the longitudinal extent of the spring housing 17. Two support pins 22 and 23 which extend parallel to the swivel axle 7 are secured on an upper region of the side walls of the support member 6 and are offset with respect to one another both in a direction longitudinally of the ski and in a direction normal to the upper side of the ski. The support pin 22 lies closer to the spring housing 17 and is provided above the leaf spring 21, and the support pin 23 lies below the leaf spring 21. The section of the leaf spring 21 adjacent the end secured on the spring housing 17 is provided with two support indentations 21b which are respectively associated with the support pins 22 and 23 and are located in the portion of the spring which is between the two support pins 22 and 23.

The heel holder operates as follows. During an automatic release, the lever 10 is pivoted against the force of the release spring 15 by the sole holder 8, which is forced upwardly by the shoe heel, until the nose 10a of the lever 10 moves past the edge 18bof the control surface 18 of the sole holder 8. The slide member 14 is simultaneously moved rearwardly in the longitudinal slots 17a in the spring housing 17 and compresses the spring 15.

If a force acts onto the foot of the skier in a so-called diagonal direction, then the nose 8a of the sole holder moves out of the recess 13b of the cam surface 13a of the base-plate-fixed part 13. The support member 6 then pivots laterally about the vertical axis of the pivot pin 5, and the sole holder simultaneously pivots upwardly about the swivel axle 7. Upon the occurrence of a purely lateral force, the heel holder 1, as has already been mentioned, remains closed, due to the engagement of the sole holder nose 8a in the recess 13b of the base-plate-fixed part 13.

During a voluntary release operation, the release lever 20 is manually pivoted, together with the spring housing 17, about the axle 7 either in the direction of the arrow $F_2$ or in the direction of the arrow $F_1$, until the slide member 14 no longer engages the control surface 10b of the lever 10. This permits the sole holder 8 to be swung upwardly by the heel of the ski shoe while pivoting the lever 10 about the holding axle 9, which pivoting is substantially free of the force of spring 15. This movement of sole holder 8 is assisted by an opening spring 24 which is arranged in the region of the swivel axle 7.

During an opening of the sole holder 8 by manually pressing the release lever 20, the spring housing 17 pivots about the swivel axle 7. The leaf spring 21 which is secured on the spring housing 17 engages the support pin 22 which is secured above the leaf spring 21 on the support member 6 and is moved into the tensioned position which is illustrated in FIG. 2. When the sole holder 8 is in its open position, the leaf spring 21 urges the spring housing 17 toward its initial position, which in turn urges the lever 10 toward its initial position. The heel holder 1 is then ready to be stepped into.

If on the other hand the voluntary opening of the sole holder is effected by manually pulling on the release lever 20, then the leaf spring 21 engages the second support pin 23 which is arranged below the leaf spring 21 on the support member 6 and is thereby tensioned (see FIG. 3). The support pin 23, like the support pin 22, is supported during an opening of the sole holder 8 by pressing on the release lever 20 in its associated support indentation 21b in the leaf spring 21. Also, in this case, the leaf spring 21 presses the spring housing 17 and the lever 10 toward their initial positions after the sole holder 8 has been swung into its open position and the skier has let go of the lever 20.

Figure 4A:
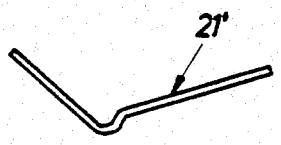
FIG. 4*a* is a side view of a leaf spring which is a component of, the binding of FIG. 4.
Figure 4:
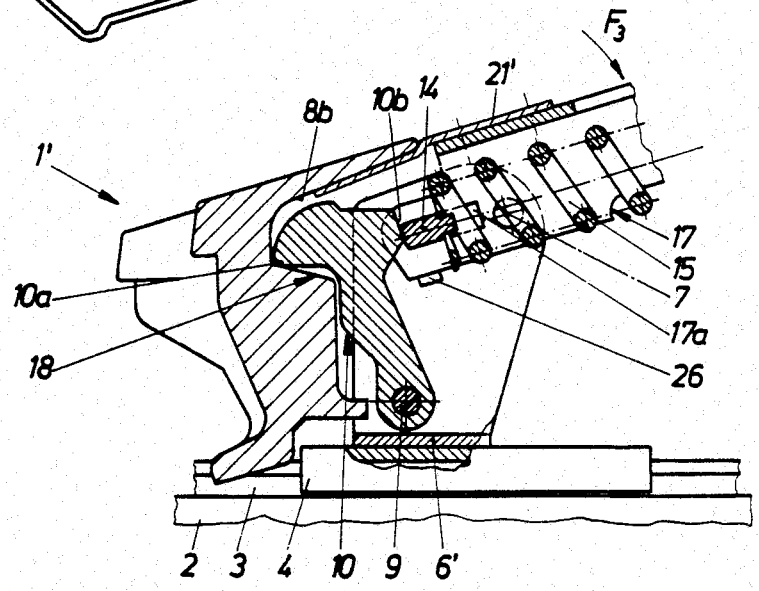
FIG. 4 is a sectional side view of a second exemplary embodiment of the inventive safety ski binding in the downhill skiing position and with a release lever omitted.

The heel holder 1' which is illustrated in FIG. 4 corresponds substantially with the heel holder 1 which is illustrated in FIGS. 1 to 3, except that the support member 6' cannot be swivelled about a vertical axis. With this, the structural parts which are required for such swivelling are absent. Two stops 26 are secured on the support member 6' below the spring housing 17 and engage the housing 17 in the downhill skiing position, which stops 26 extend inwardly from the side walls of the support member 6' under the two side walls of the spring housing 17. The centering spring of this exemplary embodiment is also constructed as a leaf spring 21', one end of which is secured to the spring housing 17 and which projects into the region between the sole holder 8 and the lever 10 and is supported against the inner surface 8b of the sole holder 8 with a strong initial tension. FIG. 4a illustrates the leaf spring 21' in its relaxed position. The section of the leaf spring 21' which is adjacent the end which is secured to the spring housing 17 is designed approximately V-shaped. The stops 26 which are secured on the support member 6' are positioned so that the sole holder 8 can be manually swung into its open position only by pressing the release lever 20 in the direction of the arrow $F_3$ in FIG. 4, because the stops 26 prevent a swinging of the release lever 20 together with the spring housing 17 in a counterclockwise direction. When the sole holder 8 is in its open position, the leaf spring 21', with its free end supported on the inner surface 8b of the sole holder 8, continues to be under an initial tension, even though a small initial tension, and urges the spring housing 17 and the lever 10 toward their initial positions, namely, their downhill skiing positions. In this exemplary embodiment, the use of a separate opening spring is not needed, since the leaf spring 21' biases the sole holder 8 toward its open position. The leaf spring 21' is relaxed, if desired with a small initial tension, in the position of the heel holder 1' in which it is ready for a stepping in.

Figure 5:
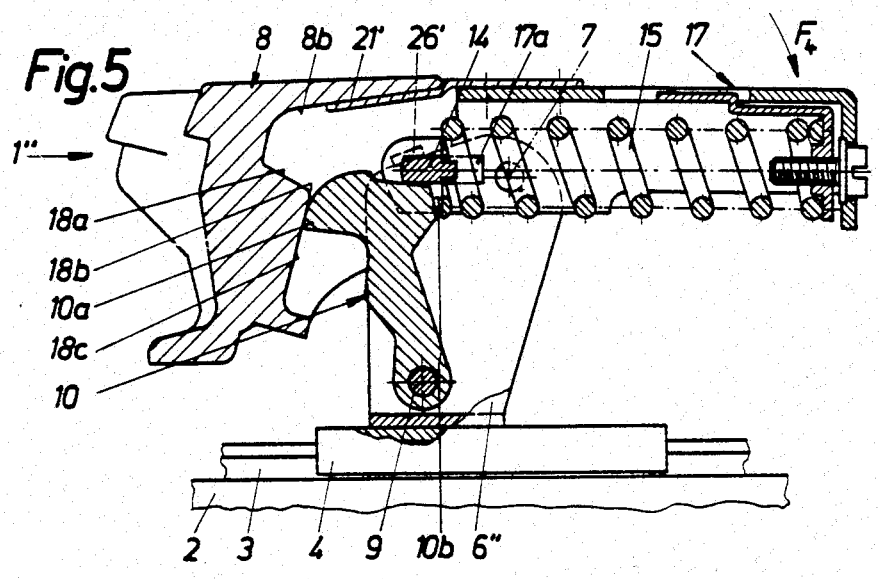
FIGS. 5 and 6 are sectional side views of a third exemplary embodiment of the inventive safety ski binding in operational positions which are respectively analogous to the positions shown in FIGS. 1 and 3, a release lever being omitted in each figure.
Figure 6:
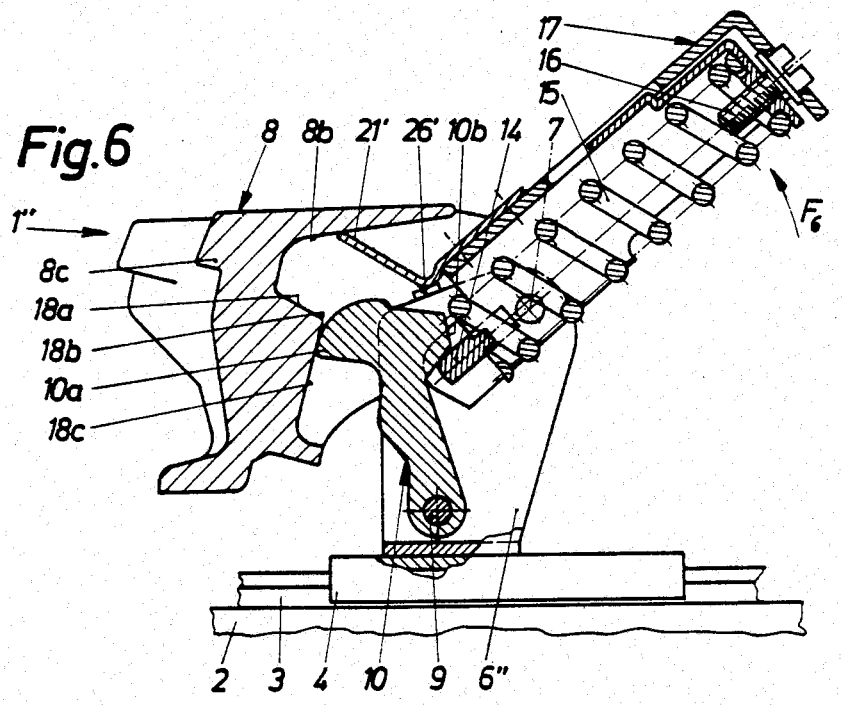

In the exemplary embodiment which is illustrated in FIGS. 5 and 6, the heel holder 1'' is similar to the heel holder 1' which is illustrated in FIG. 4, but lacks the stops 26. The design and the arrangement of the leaf spring 21' which is provided as a centering spring also corresponds with the preceding exemplary embodiment. Support ramps 26' are secured at the upper edges of the two side walls of the support member 6''. The sole holder 8 of the heel holder 1'' can be opened voluntarily both by pulling on and also by pressing on the release lever 20. Opening it by pressing on the release lever 20 in the direction of the arrow $F_4$ (FIG. 5) leads to a return of the spring housing 17 in the manner which is described in the exemplary embodiment according to FIG. 4. If the sole holder 8 is swung into its open position by pulling on the release lever 20 in the direction of the arrow F6 (FIG. 6), the support ramps 26' which are secured on the support member 6' engage the leaf spring 21' in the region of the tip of its V-shaped area and in this manner hold the leaf spring 21' under additional tension, so that a return and centering of the spring housing 17 is assured. In this exemplary embodiment, the leaf spring 21' also functions as an opening spring which urges the sole holder 8 upwardly toward its open position.

It is again pointed out that during a voluntary opening of the sole holder 8 in all described embodiments, a compressing or overcoming of the force of the release spring 15 does not take place, and only small frictional forces need to be overcome. The force of the leaf springs 21 and 21' and thus their thickness can therefore be kept small.

Figure 7:
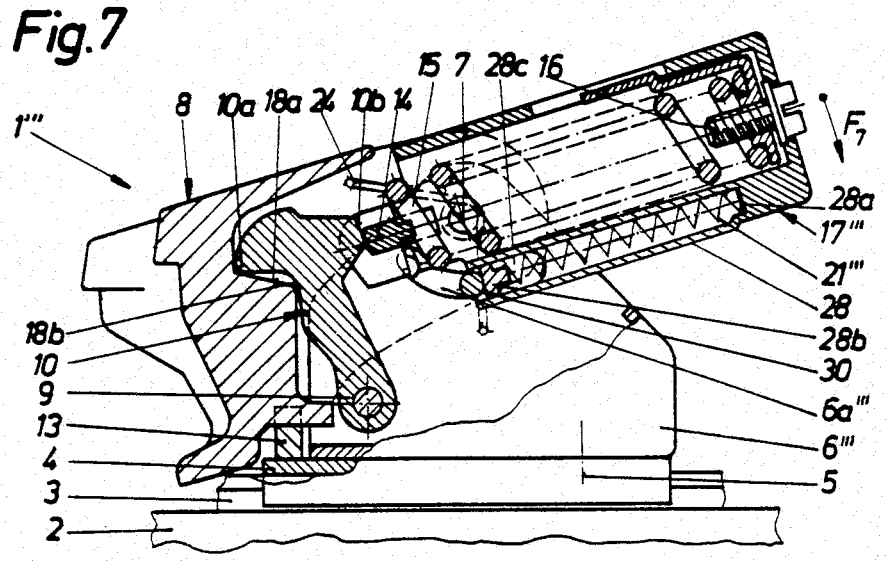
FIG. 7 is a sectional side view of a fourth exemplary embodiment of the inventive safety ski binding in the downhill skiing position and with a release lever omitted.
Figure 7A:
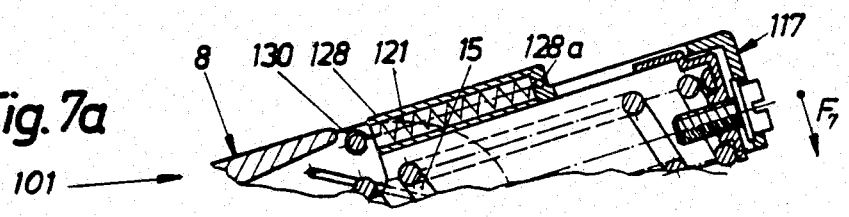
FIG. 7*a* is a fragmentary sectional side view illustrating a modification of the exemplary embodiment of FIG. 7.

FIG. 7 illustrates a further exemplary embodiment of an inventive heel holder 1''', the design of which and the operation of which during an automatic release operation corresponds substantially with the design and operation of the heel holder which is illustrated in FIGS. 1 to 3. The heel holder 1''' has a support member 6''', which is pivotal about the vertical axis defined by a pivot pin 5 and on which the sole holder 8 is supported pivotally for movement about the swivel axle 7. The lever 10 is furthermore supported on the support member 6''' on the holding axle 9, and is under the action of the force of the release spring 15 which is arranged in the spring housing 17. The centering spring of the heel holder 1''' is a helical compression spring 21''' and is arranged in a spring housing 28 which is, for example, cylindrical in cross section and is provided on the underside of the spring housing 17, which underside faces the upper side of the ski. The pressure spring 21''' is arranged centrally below the release spring 15 and extends longitudinally in the same direction. One end of the spring housing 28 is closed and forms an abutment **28*a* which is fixedly connected to the spring housing 17, on which abutment one end of the pressure spring 21''' is supported. The other end of the pressure spring 21''' is supported, with the interpositioning of an abutment 28*b* which is movably supported in the spring housing 28, on a support bolt or pin 30 which is secured on the sole holder 8, extends parallel to the swivel axle 7, and is connected to the two side walls of the sole holder 8 which partially grip around the support member 6, approximately in the region below the two swivel pins 7*a*. In order to permit the sole holder 8 to carry out its pivoting movement about the swivel axle 7, a slot 6*a'''* which extends concentrically with respect to the swivel axle 7 is constructed in each of the two side walls of the support member 6, through which slots 6*a* the support bolt 30** extends.

During a voluntary opening of the sole holder 8 through pressure on the release lever or on spring housing 17 in the direction of the arrow $F_7$ in FIG. 7, the spring housing 17 pivots about the swivel axis 7 until the slide member 14 no longer engages the control surface **10*b* of the lever 10, and the sole holder 8 then pivots, with the assistance of the opening spring 24, into its open position. The compression spring 21''' which biases the support bolt 30 of the sole holder 8 is thereby compressed, and the support bolt 30 is received in recesses 28*c* provided in the spring housing 28 at the end adjacent the support bolt 30, which recesses 28*c* open toward the support bolt 30. Due to the fact that the pressure spring 21''' is supported below the swivel axis 7 of the spring housing 17 on the sole holder 8, the spring housing 17, after the skier lets go of the release lever, is urged in a counterclockwise direction and the spring housing 17 swings, with a relaxation of the spring 21''', into its initial position and in turn urges the lever 10 into its initial position. The heel holder 1'''** is then ready for a stepping in.

As can be seen from FIG. **7*a*, in place of the compression spring 21''' it is also possible to use an expansion spring 121 which is arranged in a spring housing 128 provided on and above the spring housing 117, one end of which is supported on a support bolt 130 which is secured above the swivel axle 7 on the sole holder 8, and the other end of which is supported on an abutment part 128*a* of the spring housing 117. In the case of this spring arrangement, a return of the spring housing 117 and the release lever also occurs after a release of the sole holder 8 by manually pressing the release lever. By arranging the expansion spring 121 above the swivel axle 7, the spring housing 117**, after the skier lets go of the release lever, is urged in a counterclockwise direction, which effects its return.

Figure 8:
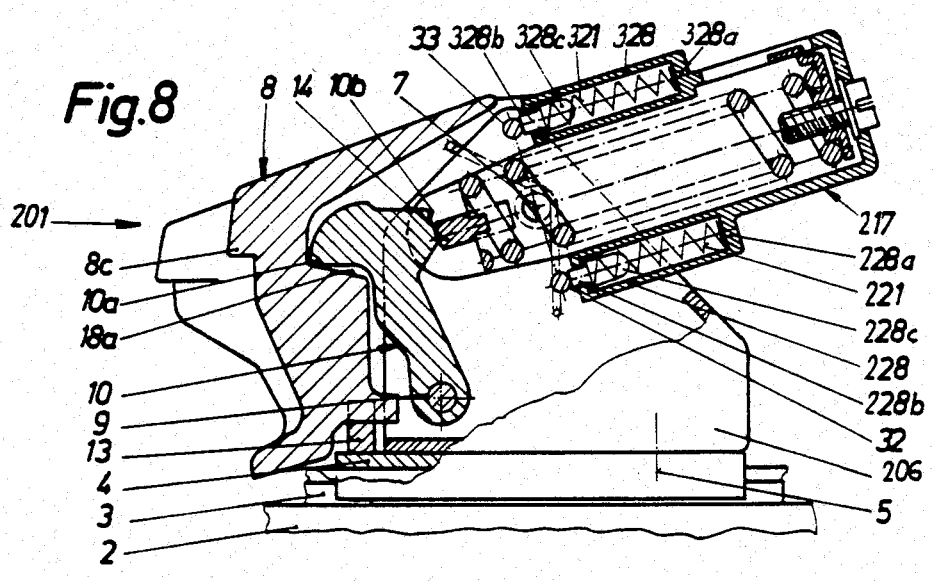
FIG. 8 is a sectional side view of a further exemplary embodiment of the inventive safety ski binding in an operational position which is analogous to FIG. 7 and with a release lever omitted.

If, in place of the expansion spring, two compression springs are used, as shown in FIG. 8, then a return or centering of the spring housing 17 is assured after opening the sole holder 8 by pulling on the release lever and also after opening it by pressing on the release lever. An arrangement of two compression springs 221 and 321 is illustrated in FIGS. 8 and **8*a*. Each spring 221 or 321 is arranged in a respective cylindrical spring housing 228 or 328, the latter being secured on and above and the former on and below the spring housing 17. One end of each spring housing 228 and 328 is closed and forms an abutment 228*a* or 328*a* which is fixedly connected to the spring housing 17 and on which one end of a respective spring 221 or 321 is supported. The other end of each spring 221 or 321 is supported, by a respective abutment 228*b* or 328*b* which is movable within the associated spring housing 228 or 328, on a respective support bolt 32 or 33 which is secured to the support member 206. The support bolts 32 and 33 have their ends secured on the respective side walls of the support member 206 and extend parallel to the swivel axle 7. Each spring housing 228 or 328 has on both sides thereof recesses 228*c*** *or* *328c* which can receive a respective support bolt 32 or 33 and thus assure a compressing of the springs 221 and 321. The operation of the springs 221 and 321 corresponds generally to the operation of the spring of the exemplary embodiment according to FIG. 7. A return of the spring housing 117 occurs after a voluntary opening of the sole holder 8 by pressing or by pulling on the release lever.

Figure 9:
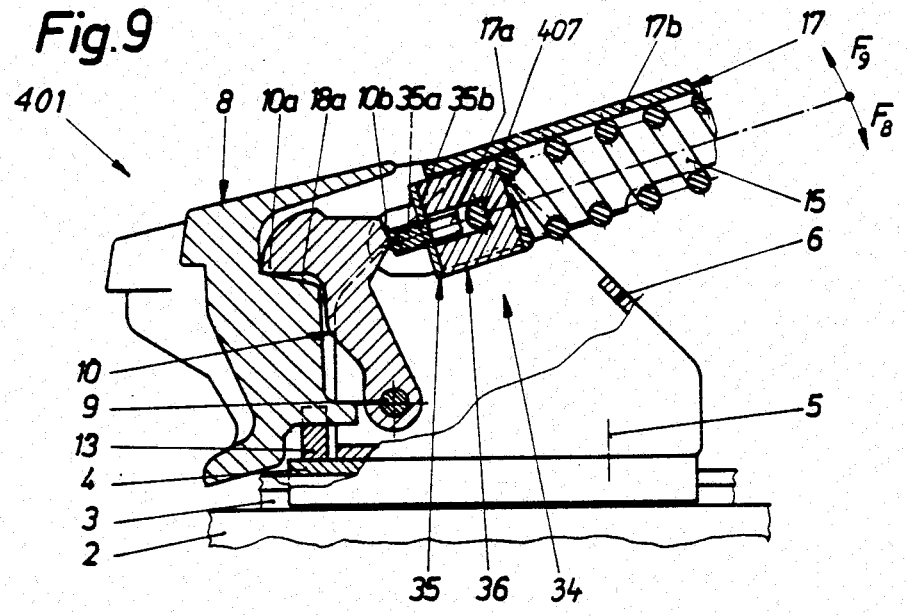
FIG. 9 is a sectional side view of a further exemplary embodiment of the inventive safety ski binding in the downhill skiing position and with a release lever omitted.

A further exemplary embodiment of a heel holder 401 is illustrated in FIGS. 9 and **9*a*. An important difference between this heel holder and the aforedescribed heel holders resides in the design of the slide member 34 which is biased by the release spring 15 and the design of the swivel axle 407 of the spring housing 17 and sole holder 8. The slide member 34 includes two slide-member parts 35 and 36, one of which engages the control surface 10*b* of the lever 10 and is movably guided by two laterally extending shoulders 35*a* in slots 17*a* which are provided in the side walls of the spring housing 17. The portion of the slide-member part 35 which does not face the lever 10 is designed as a support plate 35*b* against which the second slide-member part 36 which is biased by the release spring 15 is supported. The slide-member part 36 is an approximately U-shaped structural part, on the bight of which an end of the release spring 15 is supported, and which is arranged longitudinally movably within the spring housing 17. The two legs of the slide-member part 36 extend longitudinally of the spring housing 17 and parallel to the housing part 17*b* and, being under the urging of the release spring 15, engage the slide-member part 35. The swivel axle 407 of the spring housing 17 and sole holder 8 is a centering bolt which is provided with a preferably flat control surface 37***a* and extends through the slide-member part 36 in the region between its two legs and also through the spring housing 17, and is secured against rotation on the support member 6. In the downhill skiing position of the heel holder 401, the control surface 37*a* of the centering bolt, due to the action of the release spring 15, engages the inner surface of the bight of the slide-member part 36.

Figure 9A:
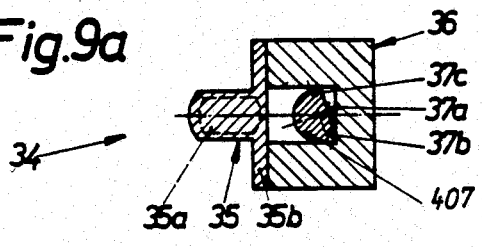
FIG. 9*a* is an enlarged, sectional view of a portion of FIG. 9.
Figure 8A:
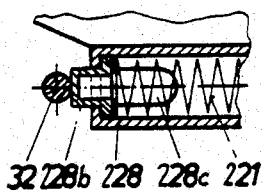
FIG. 8*a* is an enlarged sectional view of a portion of FIG. 8.

An automatic release of the heel holder 401 occurs in the manner which is described in the exemplary embodiment according to FIGS. 1 to 3. A voluntary opening of the sole holder 8 is possible by pressing (arrow $F_8$) and also by pulling (arrow $F_9$) on the release lever. During an opening of the sole holder 8 by pressing on the release lever, the spring housing 17 pivots about the swivel axle 407. The centering bolt which forms the swivel axle 407 remains in its position, and the U-shaped slide-member part 36 which swivels with the spring housing 17 thus becomes supported on the lower edge 37*b* of the control surface 37*a* of the centering bolt (see FIG. 9*a*) and moves, with a slight compression of the release spring 15, a small distance into the spring housing 17. After the skier lets go of the release lever, it is swung, together with the spring housing 17, back into its initial position by the relaxing release spring 15, whereby the spring housing 17 moves the lever 10 into its initial position. During an opening of the sole holder 8 by a pulling on the release lever, the slide-member part 36 becomes supported on the upper edge 37*c* of the support surface 37*a* of the centering bolt. The return movement occurs in a manner similar to that just described.

The design of the slide member 34 in two parts 35 and 36 facilitates the installation of the release spring 15 in the spring housing 17, which is closed in the region of the adjusting screw 16. However, it is conceivable to design the spring housing 17 in such a manner that an installation of the release spring 15 is also possible from the region which is provided with the adjusting screw 16. Through this, a two-part design of the slide member 34 is not needed, and it can be a single part. Of course, the slide member 34 which in this exemplary embodiment is designed as a substantially square-shaped member can also be circular or of other appropriate cross-sectional shape, depending on the design of the spring housing 17.

The invention is not limited to the illustrated exemplary embodiments. Further variations or modifications, including the rearrangement of parts, are possible without leaving the scope of the invention. Thus, it is possible to provide almost all known heel holders with one of the described centering springs, in which the release spring during a voluntary opening of the sole holder is swung away from the structural parts which keep the sole holder locked.

The embodiments of the invention in which an exclusive property or privilege is claimed are defined as follows:

1. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported for movement about a swivel axis wherein said slide member is, in every position of said locking lever when said sole holder is in said downhill skiing position, substantially normal to said control surface; and centering means cooperable with said release lever and said spring housing for yieldably resisting pivotal movement thereof away from an initial positon, said centering means including a leaf spring having one end secured on said spring housing and having section adjacent said one end which is supported, in said downhill skiing position, on a surface of said sole holder, wherein said leaf spring is secured on a part of said spring housing which covers said release spring from above, engages an inner surface of said sole holder which faces said locking lever, and is arranged to extend between two support pins which are secured on said support member, which are parallel to the swivel axis of said spring housing, and which are offset with respect to one another in a direction longitudinally of the ski and also in a direction normal to the upper side of the ski.

2. The safety ski binding according to claim 1, wherein a section of said leaf spring which is adjacent said one end which is secured on said spring housing has, between said support pins, two support indentations which are each associated with a respective one of said support pins.

3. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including a leaf spring having one end secured on said spring housing and having a section adjacent said one end which is supported, in said downhill skiing position, on a surface of said sole holder, wherein said section of said leaf spring is approximately V-shaped in a relaxed position of said leaf spring and, in said downhill skiing position of said sole holder, extends approximately in the same longitudinal direction as said spring housing and exerts a strong initial tension onto said sole holder, and wherein said leaf spring, when said sole holder is in said release position, is substantially relaxed.

4. The safety ski binding according to claim 3, wherein pivotal movement of said spring housing and said release lever is limited by a stop which is fastened on said support member and projects under two side walls of said spring housing to prevent swivelling of said spring housing in response to manual application of a pulling force to said release lever.

5. The safety ski binding to claim 3, wherein said leaf spring, in the region of a tip of said V-shaped section thereof, can engage, during a swinging up of said release lever and said spring housing, support parts which are secured on both sides of an upper region of said support member.

6. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including a leaf spring having one end secured on said spring housing and having a section adjacent said one end which is supported, in said downhill skiing position, on a surface of said sole holder, wherein said leaf spring simultaneously biases said sole holder toward said release position.

7. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported for movement about a swivel axis, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including a helical compression spring which is arranged in a further spring housing provided on an underside of said first-mentioned spring housing; wherein one end of said helical spring is supported on an abutment which is fixedly connected to said first-mentioned spring housing and the other end thereof is supported on an abutment which is movably supported on a support bolt which is below and extends parallel to said swivel axis, said support bolt being supported on said sole holder; and wherein said support bolt extends through a respective slot provided in each of two side walls of said support member, which slots extend concentrically with respect to said swivel axis of said sole holder.

8. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including a helical expansion spring which is arranged in a further spring housing secured on an upper side of said first-mentioned spring housing; and wherein one end of said expansion spring is supported on an abutment part which is fixedly connected to said first-mentioned spring housing and the other end is supported on a support bolt which is above and parallel to said swivel axis of said sole holder and which is supported on said sole holder.

9. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including a helical compression spring which is arranged in a further spring housing provided on an underside of said first-mentioned spring housing; wherein one end of said helical spring is supported on an abutment which is fixedly connected to said first-mentioned spring housing and the other end thereof is supported on an abutment which is movably supported in said further spring housing and is in turn supported on a support bolt which is below and parallel to said sole holder, said bolt being supported on said sole holder; wherein the diameter of said support bolt is less than the diameter of said further spring housing; and wherein said further spring housing has, at its end which faces said support bolt, recesses for receiving said support bolt.

10. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by a release spring supported on a spring housing, said spring housing being supported in a manually operable release lever which is pivotally supported, wherein said slide member is, in every position of said locking lever when said sole holder is in said downhill skiing position, substantiall normal to said control surface; and centering means cooperable with said release lever and said spring housing for yieldably resisting pivotal movement thereof away from an initial position, said centering means including two helical compression springs which are each arranged in a respective further spring housing, one of said further spring housings being provided on an upper side of and the other of said further spring housings being provided on a lower side of said first-mentioned spring housing; wherein one end of each said compression spring is supported on an abutment which is fixedly connected to said first-mentioned spring housing and the other end thereof is supported on an abutment which is movably supported within the associated further spring housing; wherein each said abutment is supported on a respective support bolt which in turn is supported on said support member and extends parallel to said swivel axis of said first-mentioned spring housing; wherein the diameter of each said support bolt is less than the diameter of the associated further spring housing; and wherein each said further spring housing has, at its end which faces the asociated support bolt, recesses for receiving the associated support bolt.

11. A safety ski binding, comprising: a support member; a sole holder supported for pivotal movement around a swivel axis on said support member between release and downhill skiing positions; locking means for releasably holding said sole holder in said downhill skiing position, said locking means permitting said sole holder to move away from said downhill skiing position only after predetermined release forces are exceeded, said locking means including a locking part provided on a pivotally supported locking lever, said locking lever having on a side remote from said locking part a control surface which is slidably engaged by a slide member which is biased toward said control surface by release spring supported on a spring housing, said spring housing being supported in a manually operable release lever which is pivotally supported, wherein said slide member is, in every position of said locking lever when said sole holder is in said downhill skiing position, substantially normal to said control surface; and centering means cooperable with said release lever and said spring housing for yieldably resisting pivotal movement thereof away from an initial position, said centering means including said spring housing being pivotally supported on a centering bolt which extends through a recess provided in said slide member, which is supported nonrotatably on said support member, and which has on its side thereof which faces said release spring a generally flat control surface which, in said downhill skiing position of said sole holder, engages a generally flat surface of said recess in said slide member, said surface on said slide member being urged by said release spring against said surface on said bolt; wherein said slide member includes first and second slide-member parts, said first slide-member part engaging said locking lever, being guided in slots provided in said spring housing, and being engaged and biased by said second slide-member part, said second slide member part being biased by said release spring, being approximately U-shaped and having two spaced legs, said centering bolt being disposed between said legs.

* * * * *

UNITED STATES PATENT AND TRADEMARK OFFICE

CERTIFICATE OF CORRECTION

PATENT NO. : 4 508 361

DATED : April 2, 1985

INVENTOR(S) : Josef SVOBODA et al

It is certified that error appears in the above-identified patent and that said Letters Patent is hereby corrected as shown below:

Column 12, line 17; after "having" insert ---a---.

Column 14, line 56; after "supported" insert ---for movement about a swivel axis---.

Column 15, line 3; after "said" insert ---swivel axis of said---.

Signed and Sealed this

*First* Day of *October 1985*

[SEAL]

*Attest:*

*Attesting Officer*

DONALD J. QUIGG

*Commissioner of Patents and Trademarks—Designate*